United States Patent [19]

Adams et al.

[11] Patent Number: 4,744,916

[45] Date of Patent: May 17, 1988

[54] NON-GELLING NON-AQUEOUS LIQUID DETERGENT COMPOSITION CONTAINING HIGHER FATTY DICARBOXYLIC ACID AND METHOD OF USE

[75] Inventors: Richard Adams; Michael C. Crossin, both of Kendall Park, N.J.

[73] Assignee: Colgate-Palmolive Company, New York, N.Y.

[21] Appl. No.: 756,334

[22] Filed: Jul. 18, 1985

[51] Int. Cl.[4] ..... C11D 10/02; C11D 3/075; C11D 3/39

[52] U.S. Cl. ..... 252/99; 252/139; 252/174.19; 252/174.21; 252/DIG. 14

[58] Field of Search ..... 252/DIG. 14, 174.19, 252/174.21, 95, 135, 139, 99

[56] References Cited

U.S. PATENT DOCUMENTS

| | | | |
|---|---|---|---|
| 3,579,453 | 5/1971 | Dupre et al. | 252/174.19 |
| 3,630,929 | 12/1971 | Van Dijk | 252/136 |
| 3,734,859 | 5/1973 | Ward | 252/108 |
| 3,812,041 | 5/1974 | Iaamorato | 252/89 |
| 3,893,955 | 7/1975 | Hewitt et al. | 252/551 |
| 3,956,161 | 5/1976 | Woodward | 252/174.19 |
| 4,062,814 | 12/1977 | Hansen | 252/529 |
| 4,092,273 | 5/1978 | Inamorato et al. | 252/548 |
| 4,240,919 | 12/1980 | Chapman | 252/133 |
| 4,277,378 | 7/1981 | Tsujii et al. | 252/546 |
| 4,316,812 | 2/1982 | Hancock et al. | 252/99 |
| 4,622,173 | 11/1986 | Broze et al. | 252/528 |

*Primary Examiner*—Paul Lieberman
*Assistant Examiner*—Linda D. Skaling
*Attorney, Agent, or Firm*—H. S. Sylvester; N. Blumenkopf; M. M. Grill

[57] ABSTRACT

The gelling temperature of liquid nonionic detergents is lowered by 2° C. or more by the addition of aliphatic linear or aliphatic monocyclic dicarboxylic acids such as the $C_6$ to $C_{12}$ alkyl and alkenyl derivatives of succinic acid or maleic acid and the corresponding anhydrides. Non-aqueous heavy duty built liquid laundry detergent compositions which do not gel when added to water at a temperature near freezing are disclosed.

15 Claims, No Drawings

NON-GELLING NON-AQUEOUS LIQUID DETERGENT COMPOSITION CONTAINING HIGHER FATTY DICARBOXYLIC ACID AND METHOD OF USE

BACKGROUND OF THE INVENTION

1. Field of Invention

This invention relates to a liquid detergent composition containing a liquid nonionic surfactant. More particularly, this invention relates to liquid detergent compositions, particularly non-aqueous liquid laundry detergent compositions which are stable against phase separation and gelation and are easily pourable and to the use of these compositions for cleaning soiled fabrics.

2. Discussion of Prior Art

Liquid laundry detergent compositions are well known in the art and in recent years have been actively and successfully commercialized. Because the liquid detergents are considered to be more convenient to use than dry powdered or particulate products, they have found substantial favor with consumers. They are readily measurable, speedily dissolved in the wash water, capable of being easily applied in concentrated solutions or dispersions to soiled areas and are non-dusting, and they usually occupy less storage space. Additionally, the liquid detergents may have incorporated in their formulations materials which could not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

One particularly severe problem of the liquid laundry detergents based on liquid nonionic surfactants, especially non-aqueous formulations, is that the nonionics tend to gel when added to cold water. This is a particularly important problem in the ordinary use of European household automatic washing machines where the user places the laundry detergent composition in a dispensing unit (e.g. a dispensing drawer) of the machine. During the operation of the machine the detergent in the dispenser is subjected to a stream of cold water to transfer it to the main body of wash solution. Especially during the winter months when the detergent composition and water fed to the dispenser are particularly cold, the detergent viscosity increases markedly and a gel forms. As a result some of the composition is not flushed completely off the dispenser during operation of the machine, and a deposit of the composition builds up with repeated wash cycles, eventually requiring the user to flush the dispenser with hot water.

The gelling phenomenon can also be a problem whenever it is desired to carry out washing using cold water as may be recommended for certain synthetic and delicate fabrics or fabrics which can shrink in warm or hot water.

In addition to the gelling which may occur when the liquid nonionic detergent comes into contact with cold water gelling may also occur in the liquid detergent composition itself when the composition is transported or stored at low temperatures, such as in the winter months. Again, this is often a particularly severe problem in certain European countries where the common practice is to locate the clothes washer and cleaning supplies in unheated garages.

Partial solutions to the gelling problem have been proposed and include, for example, diluting the liquid nonionic detergent composition with certain viscosity controlling solvents and gel-inhibiting agents, such as lower alkanols, e.g. ethyl alcohol (see U.S. Pat. No. 3,953,380), alkali metal formates and adipates (see U.S. Pat. No. 4,368,147), hexylene glycol, polyethylene glycol, etc.

In U.S. Pat. No. 3,630,929-van Dijk, an acid substance is added to a substantially non-aqueous built liquid detergent composition containing a water-free liquid nonionic detergent surfactant, an inorganic carrier material and an inorganic or organic alkaline detergent builder to increase the rate of solution of the composition in water and to lower product viscosity. Suitable acid substances are disclosed as including inorganic acids, inorganic acid salts, organic acids, and anhydrides and organic acid salts. Among the organic acid salts, mention is made of succinic acid. Among the alkaline organic detergent builders mention is made of alkenyl succinates, e.g. sodium $C_{12}$ alkenyl succinate, e.g. sodium $C_{12}$ alkenyl succinate (anhydrous). All the data for dissolution rates and viscosities were obtained at 25° C.

Attempts have also been made to reduce the gelling tendency of liquid nonionic detergent composition by modification and optimization of the structure of the nonionic detergent surfactant. As an example of nonionic surfactant modification one particularly successful result has been achieved by acidifying the hydroxyl moiety end group of the nonionic molecule. The advantages of introducing a carboxylic acid at the end of the nonionic include gel inhibition upon dilution; decreasing the nonionic pour point; and formation of an anionic surfactant when neutralized in the washing liquor. Nonionic structure optimization has centered on the chain length of the hydrophobic-lipophilic moiety and the number and make-up of alkylene oxide (e.g. ethylene oxide) units of the hydrophilic moiety. For example, it has been found that a $C_{13}$ fatty alcohol ethoxylated with 8 moles of ethylene oxide presents only a limited tendency to gel formation. Certain mixed ethylene oxide-propylene oxide condensation products of fatty alcohols also exhibit a limited tendency to gel formation.

Nevertheless, still further improvements are desired in the gel inhibition of liquid detergent composition, especially non-aqueous liquid fabric treating detergent compositions.

Accordingly, it is an object of this invention to provide liquid nonionic surfactant-containing liquid detergent compositions which do not gel even when stored at cold temperatures for extended periods or when mixed with cold water.

It is another object of the invention to provide liquid fabric treating compositions which are suspensions of insoluble inorganic particles in a non-aqueous liquid and which are storage stable, easily pourable and dispersible in cold, warm or hot water.

Another object of this invention is to formulate highly built heavy duty non-aqueous liquid nonionic surfactant laundry detergent compositions which can be poured at all useful temperatures and which can be repeatedly dispersed from the dispensing unit of European style automatic laundry washing machines without fouling or plugging of the dispenser even during the winter months.

These and other objects of the invention which will become more apparent from the following detailed description of preferred embodiments are accomplished by adding to the liquid nonionic surfactant detergent composition a gel inhibiting compound in an amount effective to lower the gelling temperature of the nonionic surfactant compound by at least about 2° C., the gel inhibiting compound being an aliphatic linear dicarboxylic acid having at least about 6 carbon atoms in the aliphatic portion of the molecule or an aliphatic monocyclic dicarboxylic acid wherein one of the carboxylic acid groups is bonded directly to a ring carbon atom and the other carboxylic acid group is bonded to the monocyclic ring through an alkyl or alkenyl chain having at least about 3 carbon atoms.

In one specific aspect the present invention provides a liquid heavy duty laundry composition composed of a suspension of a detergent builder salt in a liquid nonionic surfactant wherein the composition includes an amount of the dicarboxylic acid gel inhibiting to lower the temperature at which the composition will form a gel to no more than about 5° C.

According to another specific aspect, the invention provides a method for dispensing a liquid nonionic laundry detergent composition into and/or with cold water without undergoing gelation. In particular, a method is provided for filling a container with a non-aqueous liquid laundry detergent composition in which the detergent is composed, at least predominantly, of a liquid nonionic surface active agent and for dispensing the composition from the container into an aqueous wash bath, wherein the dispensing is effected by directing a stream of unheated water onto the composition such that the composition is carried by the stream of water into the wash bath.

DETAILED DESCRIPTION OF THE INVENTION AND PREFERRED EMBODIMENTS

As mentioned above, it has previously been suggested to incorporate in liquid nonionic surfactant detergent compositions a free carboxylic group modified nonionic surfactant, i.e. a polyether carboxylic acid, for the purpose of lowering the temperature at which the liquid nonionic forms a gel with water. This use of the acid-terminated nonionic anti-gelling compound is disclosed in the commonly assigned copending application Ser. No. 597,948, filed Apr. 9, 1984.

While the acid-terminated nonionic gel inhibitors have in fact provided highly useful benefits when incorporated in liquid nonionic surfactant containing detergent compositions, it has now been found by the present inventors that on a weight for weight basis further improvement, e.g. lowered gelling temperature, can be provided by the $C_6$ and higher aliphatic and alicyclic dicarboxylic acids.

Thus, by replacing the acid terminated nonionic surfactant compound with an equal amount of the dicarboxylic acid compound anti-gelling agent, the gelling temperature of the nonionic/antigelling compound system and/or the gelling temperature of the nonionic/antigelling compound system in water can be further reduced (as compared to the gelling temperature of the nonionic surfactant alone or the nonionic surfactant in water) by at least about 2° C., preferably at least about 4° C., or more, depending on the nonionic surfactant and the typical amount of the anti-gelling agent.

The liquid nonionic synthetic organic detergents employed in the practice of the invention may be any of a wide variety of such compounds, which are well known and, for example, are described at length in the text *Surface Active Agents,* Vol. II, by Schwartz, Perry and Berch, published in 1958 by Interscience Publishers, and in McCutcheon's *Detergents and Emulsifiers,* 1969 Annual, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 10 to 18 carbon atoms and wherein the number of mols of lower alkylene oxide (of 2 or 3 carbon atoms) is from 3 to 16. Of such materials it is preferred to employ those wherein the higher alkanol is a higher fatty alcohol of 10 to 11 or 12 to 15 carbon atoms and which contain from 5 to 8 or 5 to 9 lower alkoxy groups per mol. Preferably, the lower alkoxy is ethoxy but in some instances, it may be desirably mixed with propoxy, the latter, if present, often being a minor (less than 50%) proportion. Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company. Other useful nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include Plurafac RA30 (a $C_{13}$-$C_{15}$ fatty alcohol condensed with 4 moles propylene oxide and 6 moles ethylene oxide), Plurafac RA40 (a $C_{13}$-$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide, Plurafac B26, and Plurafac RA50 (a mixture of equal parts Plurafac D25 and Plurafac RA40).

Generally, the mixed ethylene oxide-propylene oxide fatty alcohol condensation products can be represented by the general formula $$RO(C_2H_4O)_p(C_3H_6O)_qH,$$

wherein R is a straight or branched, primary or secondary aliphatic hydrocarbon, preferably alkyl or alkenyl, especially preferably alkyl, of from 8 to 20, preferably 10 to 18, especially preferably 14 to 18 carbon atoms, p is a number of from 2 to 12, preferably 4 to 10, and q is a number of from 2 to 7, preferably 3 to 6.

Another group of liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide; Dobanol 24-7 is an ethoxylated $C_{12}$–$C_{15}$ fatty alcohol with an average of 7 moles ethylene oxide; etc.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. A preferred molecular weight range of the liquid nonionic detergent is from about 300 to about 11,000. Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atoms content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 20% but, as is in the case, for example, of the Terigtols, may be greater.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of the anti-gelling compounds of the invention can also improve the properties of the detergents based on such nonionics. In some cases, as when a higher molecular weight polylower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures. Mixtures of two or more of these liquid nonionics can also be used and in some cases advantages can be obtained by the use of such mixtures.

As mentioned above, the structure of the liquid nonionic surfactant may be optimized with regard to their carbon chain length and configuration (e.g. linear versus branched chains, etc.) and their content and distribution of alkylene oxide units. Extensive research has shown that these structural characteristics can and do have a profound effect on such properties of the nonionic as pour point, cloud point, viscosity, gelling tendency, as well, of course, as on detergency.

Accordingly, in the compositions of this invention, one particularly preferred class of nonionic surfactants includes the C12–C13 secondary fatty alcohols with relatively narrow contents of ethylene oxide in the range of from about 7 to 9 moles, especially about 8 moles ethylene oxide per molecule and the C9 to C11, especially C10 fatty alcohols ethoxylated with about 6 moles ethylene oxide. Other and specifically preferred nonionics include Neodol 25-7, Neodol 23-6.5, Plurafac RA30 and Plurafac RA50.

The gel-inhibiting compounds used in the present invention are aliphatic linear or aliphatic monocyclic dicarboxylic acid compounds. The aliphatic portion of the molecule may be saturated or ethylenically unsaturated and the aliphatic linear portion may be straight or branched. The aliphatic monocylic molecules may be saturated or may include a single double bond in the ring. Furthermore, the aliphatic hydrocarbon ring may have 5- or 6-carbon atoms in the ring, i.e. cyclopentyl, cyclopentenyl, cyclohexyl, or cyclohexenyl, with one carboxyl group bonded directly to a carbon atom in the ring and the other carboxyl group bonded to the ring through a linear alkyl or alkenyl group.

The aliphatic linear dicarboxylic acids have at least about 6 carbon atoms in the aliphatic moiety and may be alkyl or alkenyl having up to about 14 carbon atoms, with a preferred range being from about 8 to 13 carbon atoms, especially preferably 9 to 12 carbon atoms. One of the carboxylic acid groups (—COOH) is preferably bonded to the terminal (alpha) carbon atom of the aliphatic chain and the other carboxyl group is preferably bonded to the next adjacent (beta) carbon atom or it may be spaced two or three carbon atoms from the $\alpha$-position, i.e. on the $\gamma$- or $\Delta$-carbon atoms. The preferred aliphatic dicarboxylic acids are the $\alpha,\beta$-dicarboxylic acids and the corresponding anhydrides, and especially preferred are derivatives of succinic acid or maleic acid and have the general formula:

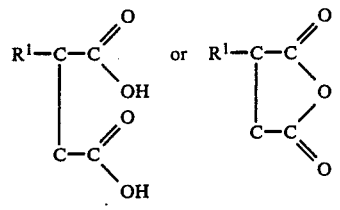

wherein $R^1$ is an alkyl or alkenyl group of from about 6 to 12 carbon atoms, preferably 7 to 11 carbon atoms, especially preferably 8 to 10 carbon atoms.

The alkyl or alkenyl group may be straight or branched. The straight chain alkenyl groups are especially preferred. It is not necessary that $R^1$ represents a single alkyl or alkenyl group and mixtures of different carbon chain lengths may be present depending on the starting materials for preparing the dicarboxylic acid.

The aliphatic monocyclic dicarboxylic acid may be either 5- or 6-membered carbon rings with one or two linear aliphatic groups bonded to ring carbon atoms. The linear aliphatic groups should have at least about 6, preferably at least about 8, especially preferably at least about 10 carbon atoms, in total, and up to about 22, preferably up to about 18, especially preferably up to about 15 carbon atoms. When two aliphatic carbon atoms are present attached to the aliphatic ring they are preferred located para- to each other. Thus, the preferred aliphatic cyclic dicarboxylic acid compounds may be represented by the following structural formula

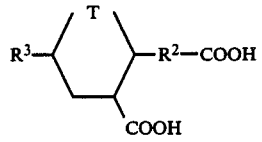

where

—T— represents $—CH_2$, —CH=, $—CH_2—CH_2$ or —CH=CH—;

$R^2$ represents an alkyl or alkenyl group of from 3 to 12 carbon atoms; and $R^3$ represents a hydrogen atom or an alkyl or alkenyl group of from 1 to 12 carbon atoms, with the proviso that the total number of carbon atoms in $R^2$ and $R^3$ is from about 6 to about 22.

Preferably —T— represents $—CH_2—CH_2—$ or —CH=CH—, especially preferably —CH=CH—.

$R^2$ and $R^3$ are each preferably alkyl groups of from about 3 to about 10 carbon atoms, especially from about 4 to about 9 carbon atoms, with the total number of carbon atoms in $R^2$ and $R^3$ being from about 8 to about 15. The alkyl or alkenyl groups may be straight or branched but are preferably straight chains.

The amount of the dicarboxylic acid gel-inhibiting compound required will, of course, be dependent on such factors as the nature of the liquid nonionic surfactant, e.g. its gelling temperature, the nature of the dicarboxylic acid, any other ingredients in the compositions which might influence gelling temperatures, and the intended use, including the intended geographical area of use, since in certain geographical areas lower temperatures will be expected than in generally warmer areas. Generally, the required amount to obtain the desired gelling temperature can be readily determined by routine experimentation. For most situations, however amounts of the dicarboxylic acid anti-gelling agent in the range of from about 2% to about 50%, preferably from about 4% to about 35%, by weight, based on the weight of the liquid nonionic surfactant, can provide gelling temperatures of the surfactant/antigelling agent system alone of no higher than about 3° C., preferably no higher than about 0° C. and down to about −20° C. or lower. Similarly, within these ranges of the anti-gelling agent, the gelling temperature of the surfactant/anti-gelling agent system in water at a weight ratio of water to surfactant/anti-gelling system of 60/40 can be as low as about 15° C., preferably as low as about 5° C., especially preferably as low as about 0° C. and below.

Incidentally, independent studies by the assignee of the present invention has shown that generally the 60/40 weight ratio of the water/surfactant mixture has the highest gelling temperature of the water/surfactant mixtures. Therefore, by adjusting the gelling temperature of the 60/40 mixture to the desired maximum acceptable gelling temperature with the anti-gelling agent, then it will be substantially assured that the detergent composition will not gel under any of the usual dilution conditions of use.

The invention detergent compositions may also include as a preferred optional ingredient water soluble and/or water insoluble detergent builder salts. Typical suitable builders include, for example, those disclosed in U.S. Pat. Nos. 4,316,812, 4,264,466, and 3,630,929. Water-soluble inorganic alkaline builder salts which can be used alone with the detergent compound or in admixture with other builders are alkali metal carbonate, borates, phosphates, polyphosphates, bicarbonates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Tripolyphosphate (TPP) is especially effective and is preferred for use in those areas where phosphate builders are not prohibited. The alkali metal silicates are useful builder salts which also have the function to make the composition anticorrosive to washing machine parts. Sodium silicates of $Na_2O/SiO_2$ ratios of from 1.6/1 to 1/3.2, especially about ½ to 1/2.8 are preferred. Potassium silicates of the same ratios can also be used.

Another class of builders highly useful herein are the water-insoluble aluminosilicates, both of the crystalline and amorphous type. Various crystalline zeolites (i.e. aluminosilicates) are described in British Pat. No. 1,504,168, U.S. Pat. No. 4,409,136 and Canadian Pat. Nos. 1,072,835 and 1,087,477, all of which are hereby incorporated by reference for such descriptions. An example of amorphous zeolites useful herein can be found in Belgium Pat. No. 835,351 and this patent too is incorporated herein by reference. The zeolites generally have the formula $$(M_2O)_x.(Al_2O_3)_y.(SiO_2)_z.WH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq 1 g.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from any grit, sand, etc.) suitable for detergents invariably contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guan.

Examples of organic alkaline sequestrant builder salts which can be used alone with the detergent or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA) and triethanolammonium N-(2-hydroxyethyl)nitrilodiacetates. Mixed salts of these polycarboxylates are also suitable.

Other suitable builders of the organic type include carboxymethylsuccinates, tartronates and glycollates. Of special value are the polyacetal carboxylates. The polyacetal carboxylates and their use in detergent compositions are described in U.S. Pat. Nos. 4,144,226; 4,315,092 and 4,146,495. Other patents on similar builders include U.S. Pat. Nos. 4,141,676; 4,169,934; 4,201,858; 4,204,852; 4,224,420; 4,225,685; 4,226,960; 4,233,422; 4,233,423; 4,302,564 and 4,303,777. Also relevant are European patent application Nos. 0015024; 0021491 and 0063399.

According to this invention the physical stability of the suspension of the detergent builder compound or compounds and any other suspended additive, such as bleaching agent, etc., in the liquid vehicle may be substantially improved by the presence of a stabilizing agent.

As disclosed in the commonly assigned copending application Ser. No. 597,948, filed Apr. 9, 1984, the disclosure of which is incorporated herein by reference, the acidic organic phosphorous compound having an acidic —POH group can increase the stability of the suspension of builder, especially polyphosphate builders, in the non-aqueous liquid nonionic surfactant.

The acidic organic phosphorus compound may be, for instance, a partial ester of phosphoric acid and an alcohol such as an alkanol which has a lipophilic character, having, for instance, more than 5 carbon atoms, e.g. 8 to 20 carbon atoms.

A specific example is a partial ester of phosphoric acid and a $C_{16}$ to $C_{18}$ alkanol (Empiphos 5632 from Marchon); it is made up of about 35% monoester and 65% diester.

The inclusion of quite small amounts of the acidic organic phosphorus compound makes the suspension significantly more stable against settling on standing but remains pourable, presumably, as a result of increasing the yield value of the suspension, while, especially for the low concentration of stabilizer, e.g. below about 1%, its plastic viscosity will generally descrease. It is believed that the use of the acidic phosphorus compound may result in the formation of a high energy physical bond between the —POH portion of the molecule and the surfaces of the inorganic polyphosphate builder so that these surfaces take on an organic character and become more compatible with the nonionic surfactant.

The acidic organic phosphorus compound may be selected from a wide variety of materials, in addition to the partial esters of phosphoric acid and alkanols mentioned above. Thus, one may employ a partial ester of phosphoric or phosphorous acid with a mono or polyhydric alcohol such as hexylene glycol, ethylene glycol, di- or tri-ethylene glycol or higher polyethylene glycol, polypropylene glycol, glycerol, sorbitol, mono or diglycerides of fatty acids, etc. in which one, two or more of the alcoholic OH groups of the molecule may be esterified with the phosphorous acid. The alcohol may be a non-ionic surfactant such as an ethoxylated or ethoxylatedpropoxylated higher alkanol, higher alkyl phenol, or higher alkyl amide. The —POH group need not be bonded to the organic portion of the molecule through an ester linkage; instead it may be directly bonded to carbon (as in a phosphonic acid, such as a polystyrene in which some of the aromatic rings carry phosphonic acid or phosphinic acid groups; or an alkylphosphonic acid, such as propyl or laurylphosphonic acid) or may be connected to the carbon through other intervening linkage (such as linkages through O, S or N atoms). Preferably, the carbon:phosphorus atomic ratio in the organic phosphorus compound is at least about 3:1, such as 5:1, 10:1, 20:1, 30:1 or 40:1.

Another useful stabilizing agent, especially where the detergent builder is a crystalline amorphous water-insoluble aluminosilicate, is aluminum tristearate, or other aluminum salt of a higher aliphatic fatty acid of from about 8 to about 22 carbon atoms, more preferably from about 10 to 20 carbon atoms. The use of aluminum stearate as a stabilizing agent for suspension of detergent builder salts in liquid nonionic detergent compositions is the subject matter of the commonly assigned application Ser. No. 707,342, filed Mar. 1, 1985. Suitable amounts of the aluminum fatty acid salt are in the range of from about 0.1 to about 3%, preferably from about 0.3 to about 1%, based on the total weight of the composition.

Furthermore, when the compositions of this invention are intended for use in especially cold surroundings, it may be advantageous to include other compounds to assist as viscosity control and gel-inhibiting agents for the liquid nonionic surface active compounds. One such useful class of additives are the low molecular weight amphiphilic compounds which can be considered to be analogous in chemical structure to the ethoxylated and/or propoxylated fatty alcohol nonionic surfactants but which have relatively short hydrocarbon chain lengths (C2–C8) and a low content of ethylene oxide (about 2 to 6 EO units per molecule).

Suitable amphiphilic compounds can be represented by the following general formula $$R^4O(CH_2CH_2O)_nH$$

where $R^4$ is a $C_2$–$C_8$ alkyl group, and n is a number of from about 1 to 6, on average.

Specific examples of suitable amphiphilic compounds include ethylene glycol monoethyl ether ($C_2H_5$—O—$CH_2CH_2OH$), diethylene glycol monobutyl ether ($C_4H_9$—O—$(CH_2CH_2O)_2H$), tetraethylene glycol monooctyl ether ($C_8H_{17}$—O—$(CH_2CH_2O)_4H$), etc. Diethylene glycol monobutyl ether is especially preferred.

Since the compositions of this invention are generally nonaqueous and highly concentrated, and, therefore, may be used at relatively low dosages, it is desirable to supplement the ordinary detergent builder, e.g. phosphate builder (such as sodium tripolyphosphate) with an auxiliary builder such as a polymeric carboxylic acid having high calcium binding capacity to inhibit incrustation which could otherwise be caused by formation of an insoluble calcium phosphate. Such auxiliary builders are also well known in the art. For example, mention can be made of Sokolan CP5 which is a copolymer of about equal moles of methacrylic acid and maleic anhydride, completely neutralized to form the sodium salt thereof. Other polyacrylic acid and polyacrylate builders are well known in the art for this purpose.

In addition to the detergent builders, various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidene sulfone, etc., most preferred are stilbene and triazole combinations.

Bluing agents such as ultramarine blue; enzymes, preferably proteolytic enzymes, such as subtilisin, bromelin, papain, trypsin and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose, complex of $C_{12}$ to $C_{22}$ alkyl alcohol with $C_{12}$ to $C_{18}$ alkylsulfate; pH modifiers and pH buffers; color safe bleaches, perfume, and anti-foam agents or suds-suppressors, e.g. silicon compounds can also be used.

The bleaching agents are classified broadly for convenience, as chlorine bleaches and oxygen bleaches. Chlorine bleaches are typified by sodium hypochlorite (NaOCl), potassium dichloroisocyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No. 4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicyclic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pat. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Preferred sequestering agents are able to form a complex with $Cu^{2+}$ ions, such that the stability constant (pK) of the complexation is equal to or greater than 6, at 25° C., in water, of an ionic strength of 0.1 mole/liter, pK being conventionally defined by the formula: $pK = -\log K$ where K represents the equilibrium constant. Thus, for example, the pK values for complexation of copper ion with NTA and EDTA at the stated conditions are 12.7 and 18.8, respectively. Suitable sequestering agents include, for example, in addition to those mentioned above diethylene triamine pentaacetic acid (DETPA); diethylene triamine pentamethylene phosphonic acid (DTPMP); and ethylene diamine tetramethylene phosphonic acid (EDITEMPA).

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

The composition may also contain an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials disclosed in U.S. Pat. No. 3,630,929, in proportions of 0.1–10%, e.g. 1 to 5%. It is preferable, however, that compositions which form peroxyacids in the wash bath (e.g. compositions containing peroxygen compound and activator therefor) be substantially free of such compounds and of other silicates; it has been found, for instance, that silica and silicates promote the undersired decomposition of the peroxyacid.

In a preferred form of the invention, the mixture of liquid nonionic surfactant and solid ingredients is subjected to an attrition type of mill in which the particle sizes of the solid ingredients are reduced to less than about 10 microns, e.g. to an average particle size of 2 to 10 microns or even lower (e.g. 1 micron). Preferably less than about 10%, especially less than about 5% of all the suspended particles have particle sizes greater than 10 microns. Compositions whose dispersed particles are of such small size have improved stability against separation or settling on storage.

In the grinding operation, it is preferred that the proportion of solid ingredients be high enough (e.g. at least about 40% such as about 50%) that the solid particles are in contact with each other and are not substantially shielded from one another by the nonionic surfactant liquid. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g., to about 40 microns) prior to the step of grinding to an average particle diameter below about 10 microns in the continuous ball mill.

In the preferred heavy duty essentially non-aqueous liquid detergent compositions of the invention, typical proportions (based on the total composition, unless otherwise specified) of the ingredients are as follows:

Suspended detergent builder, within the range of about 10 to 60% such as about 20 to 50%, e.g. about 25 to 40%;

Liquid phase comprising-nonionic surfactant and optionally dissolved amphiphilic gel-inhibiting compound, within the range of about 20 to 70%, such as about 40 to 60%, this phase may also include minor amounts of a diluent such as ethanol, isopropanol, a glycol, e.g. polyethylene glycol (e.g. "PEG 400"), hexylene glycol, etc. such as up to 10%, preferably up to 5%, for example, 0.5 to 2%. The weight ratio of nonionic surfactant to amphiphilic compound when the latter is present is in the range of from about 100:1 to 1:1, preferably from about 50:1 to about 2:1.

The aliphatic linear or aliphatic monocyclic dicarboxylic acid anti-gelling agent—from about 2% to about 50%, preferably from about 4 to 35%, based on the weight of the liquid nonionic detergent surfactant compound.

Aluminum salt of the higher aliphatic fatty acid—up to about 3%, for example, from about 0.1 to about 3%, preferably from about 0.3 to about 1%.

Acidic organic phosphoric acid compound, as anti-settling agent; up to 5%, for example, in the range of 0.01 to 5%, such as about 0.05 to 2%, e.g. about 0.1 to 1%.

Suitable ranges of other optional detergent additives are: enzymes—0 to 2%, especially 0.7 to 1.3%; corrosion inhibitors—about 0 to 40%, and preferably 5 to 30%; anti-foam agents and suds-suppressors—0 to 15%, preferably 0 to 5%, for example 0.1 to 3%; thickening agent and dispersants—0 to 15%, for example 0.1 to 10%, preferably 1 to 5%; soil suspending or anti-redeposition agents and anti-yellowing agents—0 to 10%, preferably 0.5 to 5%; colorants, perfumes, brighteners and bluing agents total weight 0% to about 2% and preferably 0% to about 1%; pH modifiers and pH buffers—0 to 5%, preferably 0 to 2%; bleaching agent—0% to about 40% and preferably 0% to about 25%, for example 2 to 20%; bleach stabilizers and bleach activators 0 to about 15%, preferably 0 to 10%, for example, 0.1 to 8%, enzyme—inhibitors—0 to 15%, for example, 0.01 to 15%, preferably 0.1 to 10%; sequestering agent of high complexing power, in the range of up to about 5%, preferably ¼ to 3%, such as about ½ to 2%. In the selections of the adjuvants, they will be chosen to be compatible with the main constituents of the detergent composition.

In this application, all proportions and percentages are by weight unless otherwise indicated. In the examples, atmospheric pressure is used unless otherwise indicated.

It is understood that the foregoing detailed description is given merely by way of illustration and that variations may be made therein without departing from the spirit of the invention.

EXAMPLE 1

The gelling points of three different liquid nonionic surfactant detergent compounds are measured alone and with various amounts of two different anti-gelling agents according to the invention as a measure of the storage stability of the detergent compositions. For comparison, the gelling temperature of the nonionic with an acid-terminated nonionic anti-gelling agent is also measured.

| Nonionic/Antigelling Agent (weight %) | Gelling Temperature (°C.) |
|---|---|
| Plurafac RA30 (100%) | 5 |
| Plurafac RA30 (75%)/Hoe S2817[1] (25%) | −6 |
| Plurafac RA30 (75%)/Neodol 91-6Ac[2] (25%) | −2 |
| Plurafac RA30 (95%)/Hoe S2817 (5%) | 3 |
| Plurafac RA30 (95%)/Neodol 91-6Ac (5%) | 2 |
| Plurafac RA30 (95%)/Westvaco Diacid 1550[3] (5%) | 3 |
| Plurafac RA50 (100%) | Below −20 |
| Plurafac RA50 (75%)/Hoe S2817 (25%) | Below −20 |
| Plurafac RA50 (75%)/Neodol 91-6Ac (25%) | −5 |
| Plurafac RA50 (95%)/Hoe S2817 (5%) | Below −20 |
| Plurafac RA50 (95%)/Neodol 91-6Ac (5%) | Below −20 |
| Plurafac RA50 (95%)/Westvaco Diacid 1550 5% | Below −20 |
| Neodol 25-7 (100%) | 21 |
| Neodol 25-7 (95%)/Hoe S2817 (5%) | 11 |

-continued

| Nonionic/Antigelling Agent (weight %) | Gelling Temperature (°C.) |
|---|---|
| Neodol 25-7 (75%)/Hoe S2817 (25%) | 2 |

[1]A $C_9$ derivative of maleic acid

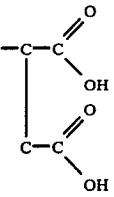

available from American Hoechst Co.

[2]Acid terminated nonionic: the esterification product of Dobanol 91-6 with succinic anhydride at a 1:1 molar complex:

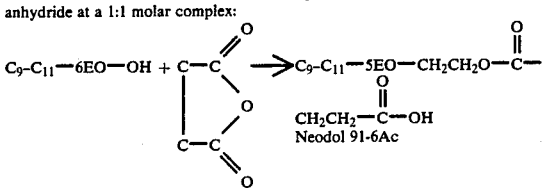

[3]A liquid monocyclic $C_{21}$ dicarboxylic acid of the formula

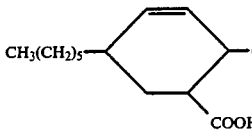

available from Westvaco.

From the above results the following observations may be drawn.

For Plurafac RA50 having a very low gelling temperature the addition of the dicarboxylic acid does not impair the gelling temperature whereas the acid terminated nonionic at the 25% level raises the gelling temperatures by at least 15° C. to −5° C.

For Plurafac RA30 the addition of 5% of antigelling agent lowered the gelling temperature by 2° C. for the dicarboxylic acid and 3° C. for the acid terminated nonionic. However, at the 25% level the aliphatic dicarboxylic acid lowered the gelling temperature by 11° C. (to −6° C.) as compared to only a 7° C. reduction for the acid terminated nonionic.

In the case of Neodol 25-7 the aliphatic dicarboxylic acid lowered the gelling temperature by 10° C. at the 5% level and by 19° C. for the 25% level.

The advantages of the dicarboxylic acid antigelling agents become even more apparent when the gelling temperatures of the 60% $H_2O$/40% nonionic/antigelling system are considered. Thus, when each of the above compositions is mixed with water to obtain a 40% concentration of the nonionic or nonionic/antigelling agent system the following results are obtained:

| Nonionic/Antigelling Agent (N/A) (weight %) | 60% $H_2O$/40% N/A System Gelling temperature (°C.) |
|---|---|
| Plurafac RA30 (100%) | 19 |
| Plurafac RA30 (75%)/Hoe S2817 (25%) | 0 |
| Plurafac RA30 (75%)/Neodol 91-6Ac (25%) | 14 |
| Plurafac RA30 (95%)/Hoe S2817 (5%) | 15 |
| Plurafac RA30 (95%)/Neodol 91-6Ac (5%) | 19 |
| Plurafac RA30 (95%)/Westraco Diacid 1550 (5%) | 16 |
| Plurafac RA50 (100%) | 4 |
| Plurafac RA50 (75%)/Hoe S2817 (25%) | −5 |
| Plurafac RA50 (75%)/Neodol 91-6Ac (25%) | 2 |
| Plurafac RA50 (95%)/Hoe S2817 (5%) | −4 |
| Plurafac RA50 (95%)/Neodol 91-6Ac (5%) | 0 |

-continued

| Nonionic/Antigelling Agent (N/A) (weight %) | 60% $H_2O$/40% N/A System Gelling temperature (°C.) |
|---|---|
| Plurafac RA50 (95%)/Westraco Diacid 1550 | 14 |
| Neqdol 25-7 (100%) | 29 |
| Neodol 25-7 (95%)/Hoe S2817 (5%) | 25 |
| Neodol 25-7 (75%)/Hoe S2817 (25%) | 0 |

From the above results it can be seen that 5% of the aliphatic dicarboxylic acid Hoe S2817 is as, or more, effective in lowering gelling temperature of the nonionic surfactant Plurafac RA30 or Plurafac RA50 than 25% of the acid terminated nonionic Neodol 91-6Ac. For Neodol 25-7, the incorporation of 25% of Hoe S2817 lowers the gelling temperature by 29° C. down to 0° C.

EXAMPLE 2

A non-aqueous built liquid detergent composition according to the invention is prepared by mixing and finely grinding the following ingredients (ground base A) and thereafter adding to the resulting dispersion, with stirring, the components B:

| | Amount Weight % (Based on A + B) |
|---|---|
| Ground Base A | |
| Plurafac RA50 | 33% |
| Hoechst Hoe S2917[1] | 16% |
| Sodium tripolyphosphate | 30% |
| Sokolan CP5 | 4% |
| Sodium carbonate | 2.5% |
| Sodium perborate monohydrate | 4.5% |
| Tetraacetylethylenediamine | 5% |
| Ethylenediamine tetraacetic acid, disodium salt | 0.5% |
| Tinopal ATS-X (optical brightener) | 0.5% |
| Post Addition B | |
| Esperase slurry[2] | 1% |
| Plurafac RA50 | 3% |

[1]A $C_9$ derivative of maleic acid

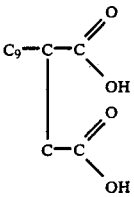

available from American Hoechst.

[2]Proteolytic enzyme slurry (in nonionic surfactant).

The resulting composition is a stable homogeneous clear liquid which remains pourable at temperatures below 0° C. and does not gel when contacted with or added to water at temperatures near freezing. The yield stress and plastic viscosity values of the composition are 3Pa and 1,400 Pa·sec, respectively. By adding 1% of aluminum tristearate to the above composition, usually with the Ground Base A, the yield stress and plastic viscosity of the composition, measured at 25° C., become 19 Pa and 1,150 Pa·sec, respectively.

EXAMPLE 3

The following heavy duty built non-aqueous liquid nonionic cleaning composition is prepared:

| Ingredient | Weight % |
|---|---|
| Neodol 25-7 | 34.0 |

-continued

| Ingredient | Weight % |
|---|---|
| Hoe S2817 | 10.0 |
| Diethylene glycol monobutyl ether | 5.0 |
| Sodium tripolyphosphate (TPP NW) | 29.09 |
| Sokolan CP5[1] (Calcium sequestering agent | 4.0 |
| Sodium perborate monohydrate (bleach) | 9.0 |
| Tetraacetylethylenediamine (TAED) (bleach activator) | 4.5 |
| Emphiphos 5632[2] (Suspension stabilizer) | 0.3 |
| Optical brightener (Stilbene 4) | 0.5 |
| Esperase (proteolytic enzyme) | 1.0 |
| Amylase enzyme | 0.6 |
| Relatin DM 4050[3] (anti-redeposition agent) | 1.0 |
| Dequest 2066[4] | 1.0 |
| Blue Foulan Sandolane (dye) | 0.01 |

[1]A copolymer of about equal moles of methacrylic acid and maleic anhydride, completely neutralized to the sodium salt.
[2]Partial ester of phosphoric acid and a $C_{16}$ to $C_{18}$ alkanol: about 1/3 monoester and 2/3 diester.
[3]Mixture of sodium carboxymethylcellulose and hydroxymethylcellulose.
[4]Diethylene triamine pentamethylene phosphoric acid, sodium salt.

The composition is stable, homogeneous and free flowing at practical temperatures and does not gel when added to or mixed with cold water. The polyphosphate builder remains stably suspended in the liquid nonionic surfactant phase over extended periods of time at both high and low temperatures.

EXAMPLE 4

| Ingredient | Weight % |
|---|---|
| Plurafac RA30 | 37.5 |
| Diethylene glycol monobutyl ether | 4.0 |
| Octenylsuccinic anhydride | 8.0 |
| TPP NW | 28.4 |
| Sokolan CP5 | 4.0 |
| Dequest 2066 | 1.0 |
| Sodium perborate monohydrate | 9.0 |
| TAED | 4.5 |
| Emphiphos 5632 | 0.3 |
| ATS-X (Optical Brightener) | 0.2 |
| Esperase | 1.0 |
| Amylase | 0.1 |
| Perfume | 0.6 |
| Relatin DM 4050 | 1.0 |
| $TiO_2$ | 0.4 |

This composition has similar properties to the composition of Example 3. The bleaching performance of this composition can be increased by the addition of as little as 0.1% of hydroxylamine sulfate as an inhibitor of the action of catalase as a peroxide decomposition catalyst.

What we claim is:

1. A non-aqueous heavy duty, built liquid laundry detergent composition which is pourable at high and low temperatures and does not gel when mixed with cold water, said composition consisting essentially of at least one liquid nonionic surfactant in an amount of from about 20 to about 70% by weight;

at least one detergent builder suspended in the nonionic surfactant in an amount of from about 10 to about 60% by weight;

an aliphatic linear alkyl or alkenyl dicarboxylic acid having at least 6 carbon atoms in the aliphatic moiety wherein one of the carboxylic acid groups is bonded to the terminal carbon atom of the alkyl or alkenyl group and the other carboxylic acid group is bonded to the $\beta$-,$\gamma$-, or $\Delta$- carbon atom of said alkyl or alkenyl group or an aliphatic $C_5$–$C_6$ monocyclic dicarboxylic acid having a total of at least 14 carbon atoms in the molecule as a gel inhibiting compound in an amount effective to lower the gelling temperature of said nonionic surfactant by at least 2° C. and effective to lower the temperature at which the composition will form a gel to no more than about 5° C.;

a peroxygen compound bleaching agent in an amount of from about 2 to about 20% by weight;

a compound of the formula $R^4O(CH_2CH_2O)_nH$ where $R^4$ is a $C_2$ to $C_8$ alkyl group and n is a number having an average value in the range of from about 1 to 6;

as a supplemental gel-inhibiting additive in an amount up to about 5% by weight;

aluminum salt of a $C_8$ to $C_{22}$ higher aliphatic carboxylic acid in an amount up to about 3% by weight; and optionally, one or more detergent adjuvants selected from the following: enzymes, corrosion inhibitors, anti-foam agents, suds suppressors, soil suspending or anti-redeposition agents, anti-yellowing agents, anti-static agents, colorants, perfumes, optical brighteners, bluing agents, pH modifiers, pH buffers, bleach stablizers, bleach activators, enzyme inhibitors and sequestering agents.

2. The composition of claim 1 wherein the gel inhibiting compound comprises the aliphatic linear dicarboxylic acid wherein the aliphatic moiety is an alkyl or alkenyl group having from 6 to 14 carbon atoms.

3. The composition of claim 1 wherein the dicarboxylic acid is a compound represented by the formula

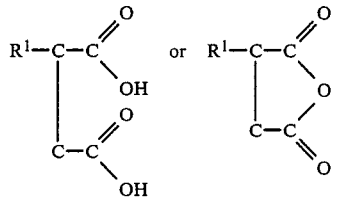

wherein $R^1$ is an alkyl or alkenyl group of from 6 to 12 carbon atoms.

4. The composition of claim 3 wherein $R^1$ is an alkyl or alkenyl group of from 7 to 11 carbon atoms.

5. The composition of claim 1 wherein the gel inhibiting compound comprises the aliphatic monocyclic dicarboxylic acid wherein the monocyclic ring is selected from the group consisting of cyclopentane, cyclopentene, cyclohexane, and cyclohexene and wherein one or two linear alkyl or alkenyl groups having from 6 and up to 22 carbon atoms are bonded to the monocyclic ring.

6. The composition of claim 5 wherein the dicarboxylic acid is a compound of formula

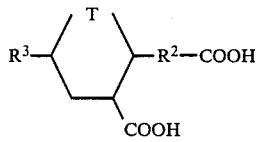

where

—T— represents —$CH_2$—, —CH=, —$CH_2$—$CH_2$—, or —CH=CH—;

$R^2$ represents an alkyl or alkenyl group of from 3 to 12 carbon atoms; and $R^3$ represents a hydrogen atom or an alkyl or alkenyl group of from 1 to 12;

with the proviso that the total number of carbon atoms in $R^2$ and $R^3$ is from 6 to 22.

7. The composition of claim 6 wherein —T— represents $—CH_2—CH_2—$ or $—CH{=}CH—$ and $R^2$ and $R^3$ are each independently alkyl groups of from 3 to 10 carbon atoms.

8. The composition of claim 1 wherein the amount of the gel inhibiting compound is in the range of from about 2 to about 50% by weight, based on the weight of the liquid nonionic surfactant.

9. The composition of claim 1 wherein the amount of the gel inhibiting compound is in the range of from about 4 to 35% by weight based on the weight of the liquid nonionic surfactant.

10. The composition of claim 1 wherein the liquid nonionic detergent compound is a poly-lower alkoxylated higher alkanol wherein the alkanol has from about 10 to about 18 carbon atoms and the lower alkylene oxide is ethylene oxide, propylene oxide or mixtures thereof and the total number of moles of lower alkylene oxide is from 3 to 16.

11. The composition of claim 1 wherein the detergent builder salt comprises an alkali metal polyphosphate detergent builder salt, a crystalline aluminosilicate detergent builder salt, or mixtures thereof.

12. The composition of claim 1 wherein the liquid nonionic surfactant is at least one mixed ethylene oxide-propylene oxide condensate of a fatty alcohol having the formula $$RO(C_2H_4O)_p(C_3H_6O)_qH$$

where R is a straight or branched, primary or secondary alkyl or alkenyl group of from 10 to 18 carbon atoms, p is from 2 to 12 and q is from 2 to 7 or a $C_{12}$ to $C_{16}$ alkanol condensed with from about 3 to 10 moles ethylene oxide, and the dicarboxylic gel inhibiting compound is a compound of formula

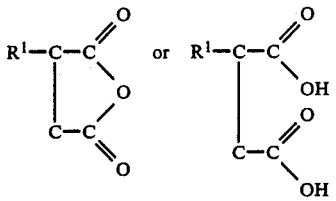

wherein $R^1$ is an alkyl or alkenyl group of from 6 to 12 carbon atoms.

13. The composition of claim 12 wherein $R^1$ is an alkyl or alkenyl group of from 8 to 10 carbon atoms.

14. The composition of claim 1 wherein liquid nonionic surfactant is present in an amount of about 40 to 60% by weight; detergent builder is present in an amount of about 20 to 50% by weight; said gel inhibiting compound is present in amount of from about 4 to 35% by weight.

15. A method for cleaning soiled fabrics which comprises contacting the soiled fabrics with the laundry detergent composition of claim 1 in an aqueous wash bath.

* * * * *